US007036160B1

(12) United States Patent
Pecoraro

(10) Patent No.: US 7,036,160 B1
(45) Date of Patent: May 2, 2006

(54) FOOTBOARD DESK

(76) Inventor: Deborah S. Pecoraro, 7431 Tolleson Ave., NW., Albuquerque, NM (US) 87114-3545

( * ) Notice: Subject to any disclaimer, the term of this patent is extended or adjusted under 35 U.S.C. 154(b) by 0 days.

(21) Appl. No.: 11/059,853

(22) Filed: Feb. 16, 2005

(51) Int. Cl.
*A47C 17/62* (2006.01)
*A47C 20/00* (2006.01)

(52) U.S. Cl. ..... 5/2.1; 5/53.1; 5/507.1; 108/49; 108/50.02; 108/77

(58) Field of Classification Search ..... 5/507.1, 5/2.1, 53.1, 661; 108/49, 50.02, 77
See application file for complete search history.

(56) References Cited

U.S. PATENT DOCUMENTS 445,777 A * 2/1891 Goodwille ..... 5/2.1
529,210 A * 11/1894 Storz et al. ..... 108/8
713,529 A 11/1902 Swindell
1,267,046 A 5/1918 Beaird
1,347,271 A 7/1920 Hartman
D110,893 S * 8/1938 Davis ..... D6/384
2,551,151 A 5/1951 McMurtrie
2,732,568 A 1/1956 Kirkwood
2,739,319 A 3/1956 Keller
2,749,197 A * 6/1956 Smith ..... 108/147
3,961,385 A 6/1976 Ferry
4,139,077 A 2/1979 Pena
4,724,555 A 2/1988 Poehner et al.
5,207,405 A * 5/1993 Cobb ..... 248/411
5,425,148 A 6/1995 Ashcraft et al.

* cited by examiner

*Primary Examiner*—Alexander Grosz
(74) *Attorney, Agent, or Firm*—Vidal A. Oaxaca; Peacock Myers, P.C.

(57) ABSTRACT

A footboard desk designed to extend over the foot of a bed to provide for an efficient use of space while maintaining the aesthetically pleasing aspects of a room's décor.

20 Claims, 4 Drawing Sheets

FOOTBOARD DESK

BACKGROUND OF THE INVENTION

1. Field of the Invention (Technical Field)

The present invention relates to a footboard for a bed comprising a desktop.

2. Description of Related Art

Note that the following discussion refers to a number of publications by author(s) and year of publication, and that due to recent publication dates certain publications are not to be considered as prior art vis-á-vis the present invention. Discussion of such publications herein is given for more complete background and is not to be construed as an admission that such publications are prior art for patentability determination purposes.

Dwelling space can be limited depending on the size of a person's living areas. Small rooms such as those found in small homes, apartments, dormitories, and hotel rooms are examples of rooms where tables or desks are difficult to accommodate.

To address the limited availability for space, or to add to the utility of beds, table tops have been incorporated into devices for use with beds. For example, U.S. Pat. No. 713,529 entitled "Table Attachment for Bedsteads", discloses a table attached to the footboard of a bed. This device is necessarily attached to the footboard of the bed because the footboard supports one end of the table, and the table's legs must be positioned a substantial distance away from the footboard.

U.S. Pat. No. 1,267,046, entitled "Writing Desk", discloses a collapsible table extension attached to the foot frame of a bed. This device is designed to fit in a barracks, and it folds down against its frame.

U.S. Pat. No. 1,347,271, entitled "Table Attachment for Bedsteads", discloses a table that is pivotally attached to either the head or foot frame of a bed. This device is held between the framing posts of the bed and is lifted from the bed.

U.S. Pat. No. 4,724,555, entitled "Hospital Bed Footboard", discloses a hospital bed footboard that can be moved from a vertical footboard position to a horizontal position over the bed. This device is designed to hold monitoring and life support devices during patient transport.

The prior art is designed to provide table tops that are attachable to beds, but there remains a need to provide a table top or desktop that is more integral to the design of a bed to accommodate the need for conserving space in a room in a more aesthetically pleasing manner.

BRIEF SUMMARY OF THE INVENTION

The present invention comprises a footboard for a bed comprising at least one support separate from the bed, a first desktop disposed on the support, the desktop extendable over a foot end of the bed and beyond the foot end of the bed, an open area beneath the desktop beyond the foot of the bed to accommodate a user's legs when the user sits at the desktop facing towards the head of the bed. The desktop is preferably at least the width of the bed.

The present invention is preferably separate from the bed.

The desktop preferably has at least two legs, at least one storage means disposed beneath the desktop, and the footboard is disposed adjacent to the foot of the bed. The storage means may comprise a drawer or a shelf.

The desktop may be extendable so that the desktop's useable surface area may be increased. The desktop may be extendable toward a head of the bed or away from a head of the bed and may comprise extendable arms to extend the desktop.

The length of the footboard's legs may be adjustable. The footboard may be attached to the bed.

The footboard may comprise a gate leg table, and the gate leg table may be pivotally attached to the footboard. The footboard may also comprise a side table.

The desktop may be pivotally attached to a second desktop that is disposed atop the desktop and is foldable toward a head of the bed. In another embodiment, the footboard may comprise a second desktop disposed horizontally and adjacent to the desktop toward a head of the bed.

The footboard may comprise at least one shelf disposed on said desktop and/or at least one shelf disposed under the desktop. The footboard may also comprise at least one electrical conduit and at least one electrical receptacle. The footboard may be free standing.

A primary object of the present invention is to provide a desktop for a bed to maximize the use of room space.

A primary advantage of the present invention is that the present invention allows for the convenience of a full desk, in a space saving and aesthetically pleasing form.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into, and form a part of, the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention relates to a footboard for a bed comprising a desk. The footboard provides for an efficient use of space while maintaining the aesthetically pleasing aspects of a room's décor.

Figure 1:
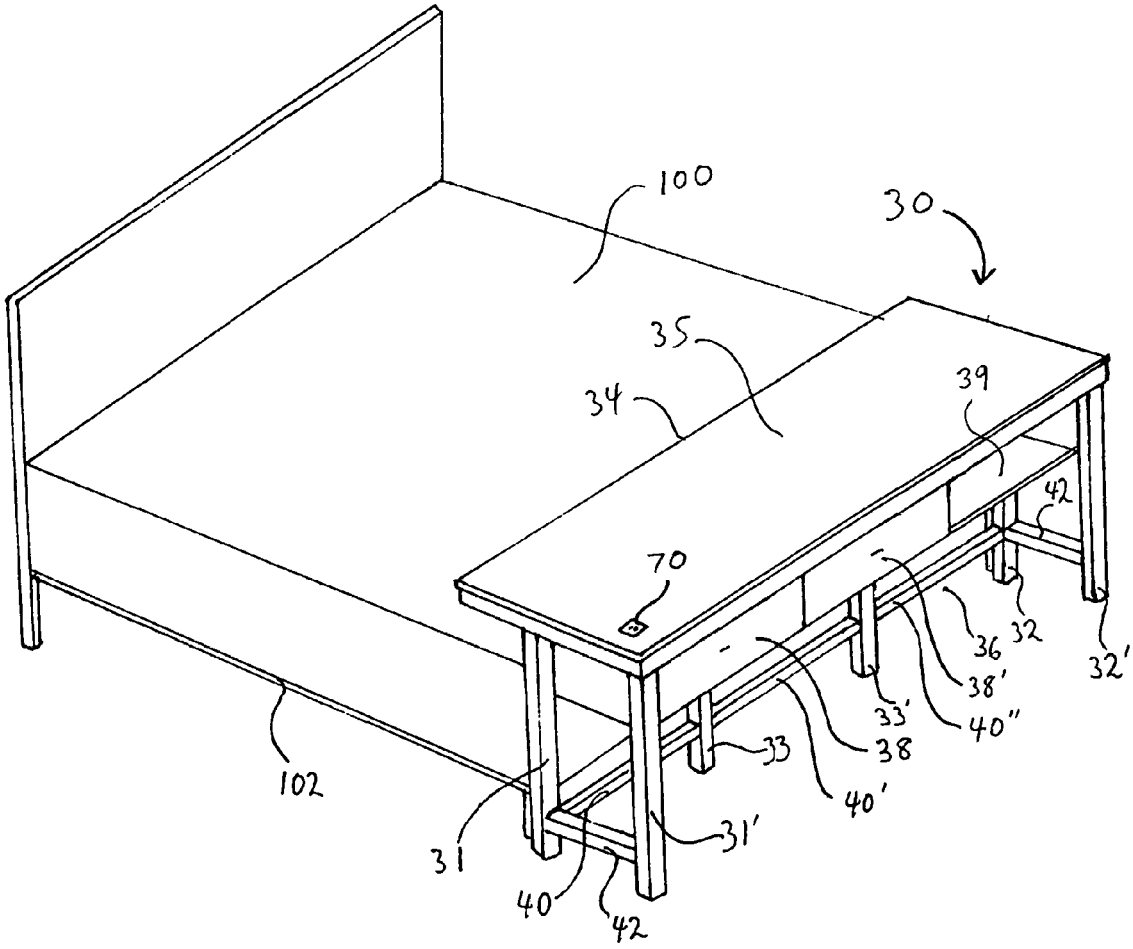
FIG. 1 is a perspective view of the preferred embodiment of the present invention.

Turning now to the drawings, FIG. 1 shows footboard 30 disposed adjacent or attached to bed 100. The invention comprises at least one support separate from bed 100. In the drawings, footboard 30 is shown comprising legs 31, 31', 32, 32', 33 and 33'. Although in the embodiment depicted in FIG. 1, six legs are shown, any number of legs sufficient to support footboard 30 may be utilized, whether footboard 30 is freestanding or attached to bed frame 102. Although FIG. 1 shows footboard 30 disposed adjacent, but not attached, to a bed frame so that it can be moved away from bed 100, footboard 30 may be attached to bed frame 102 so that footboard 30 supports bed 100. In another embodiment, footboard 30 may comprise only two legs 31, 32 that support both bed frame 102 and footboard 30.

In the preferred embodiment shown in FIG. 1, desktop 34 is supported by legs 31, 31', 32, 32', 33, and 33'. Drawers 38, 38' are disposed under desktop 34. Although two drawers 38, 38' are depicted, any number of drawers may be utilized and any other form of storage areas known in the art may be used in addition to, or as substitute for, drawers 38, 38' including, but not limited to, storage at the floor level, the sides, and even where accessible for a lift top desktop. For example, in the drawings, shelf 39 is shown adjacent to drawer 38'. The number of drawers utilized will determine, as is apparent to one skilled in the art, the number of legs 33, 33' or other frame support structures (not shown) required to provide a support frame for drawers 38, 38', 38".

The stability of legs 31, 31', 32, 32', 33, and 33' is maintained in part through the use of rear cross bars 40, 40', 40" and side cross bars 42, 42'. The height of cross bars 40, 40', 40", 42, and 42' may vary as long as they can stabilize legs 31, 31', 32, 32', 33, and 33' as is apparent to one skilled in the art. Also, the lengths of legs 31, 31', 32, 32', 33, and 33' may be adjustable to vary the overall height of footboard 30 and/or the height of desktop 34 from the ground.

Desktop 34 comprises any level surface including, but is not limited to, a desktop, a table top, and any similar hard surface. In the preferred embodiment, desktop 34 is fixed in a horizontal orientation, but may be oriented in any degree from horizontal until ready to be used. When desktop 34 is in a horizontal position, recess or open area 36 is created that can accommodate a user's legs and knees should a user choose to sit facing bed 100. As seen in the figures, in a sitting position, the desktop would be at a height that could accommodate a user's arms resting on the desktop.

As shown in FIG. 1, any number of drawers may be disposed on footboard 30. In other embodiments, other accessories include, but are not limited to, at least one shelf 39, an electrical conduit (not shown), electrical receptacle 70, a hole for cords (not shown), computer keyboard tray (not shown), etc. A shelf or shelves may be disposed on or below the desktop.

Desktop 34 is oriented over bed 100 so that a greater portion of desktop 34 extends over bed 100. Surface area 35 of desktop 34 may be maximized without minimizing space that is otherwise useable in the area in which bed 100 is situated. The width or depth of desktop 34 may be varied as desired to increase surface area 35. Regardless of the width of desktop 34, a person may either use desktop 34 while lying in bed or may sit with the person's knees set under desktop 34 within open area 36.

Figure 2:
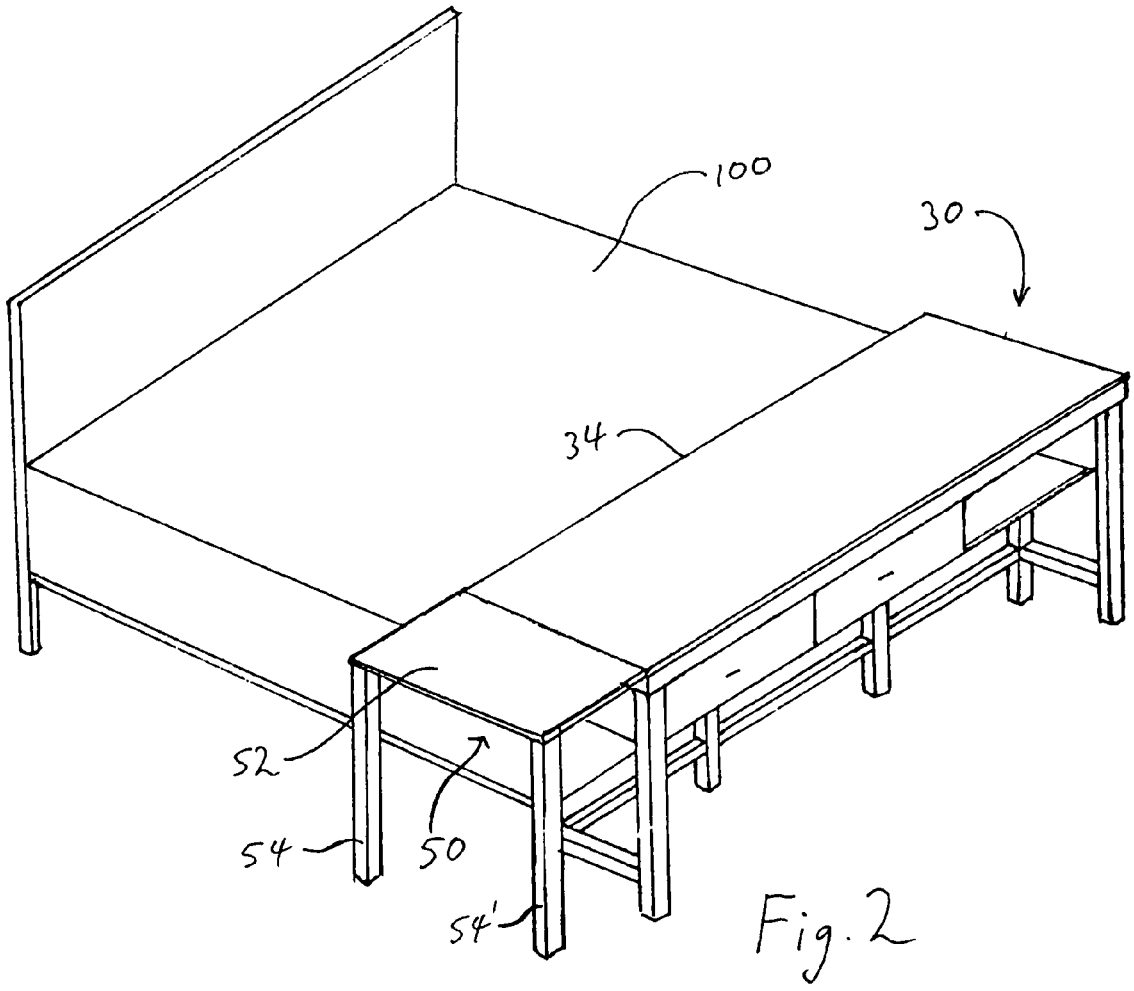
FIG. 2 is a perspective view of the embodiment of FIG. 1 with an attached gate leg table.

Any means or attachments known in the art may be utilized to maximize the useable surface of desktop 34. For example, as shown in FIG. 2, footboard 30 may also comprise at least one side table surface such as gate leg table 50 attached to any edge of desktop 34. In FIG. 2, gate leg table 50 is shown attached to a side edge of desktop 34. Gate leg table 50 may be of any type known in the art. In the preferred embodiment, gate leg table 50 comprises drop leaf 52 that is pivotally attached to desktop 34, and legs 54, 54' that are pivotally attached to drop leaf 52 so that drop leaf 52 can be swung out to a horizontal position and legs 54, 54' can be swung out to a vertical position to support the edge of drop leaf 52 opposite desktop 34. Alternatively, the side table surface may comprise a drop leaf table pivotally attached to the desktop so that the drop leaf table hangs vertically when not in use, then is swung up to a horizontal cantilevered position and locked in place using a locking mechanism (not shown) of any type known in the art.

Figure 3:
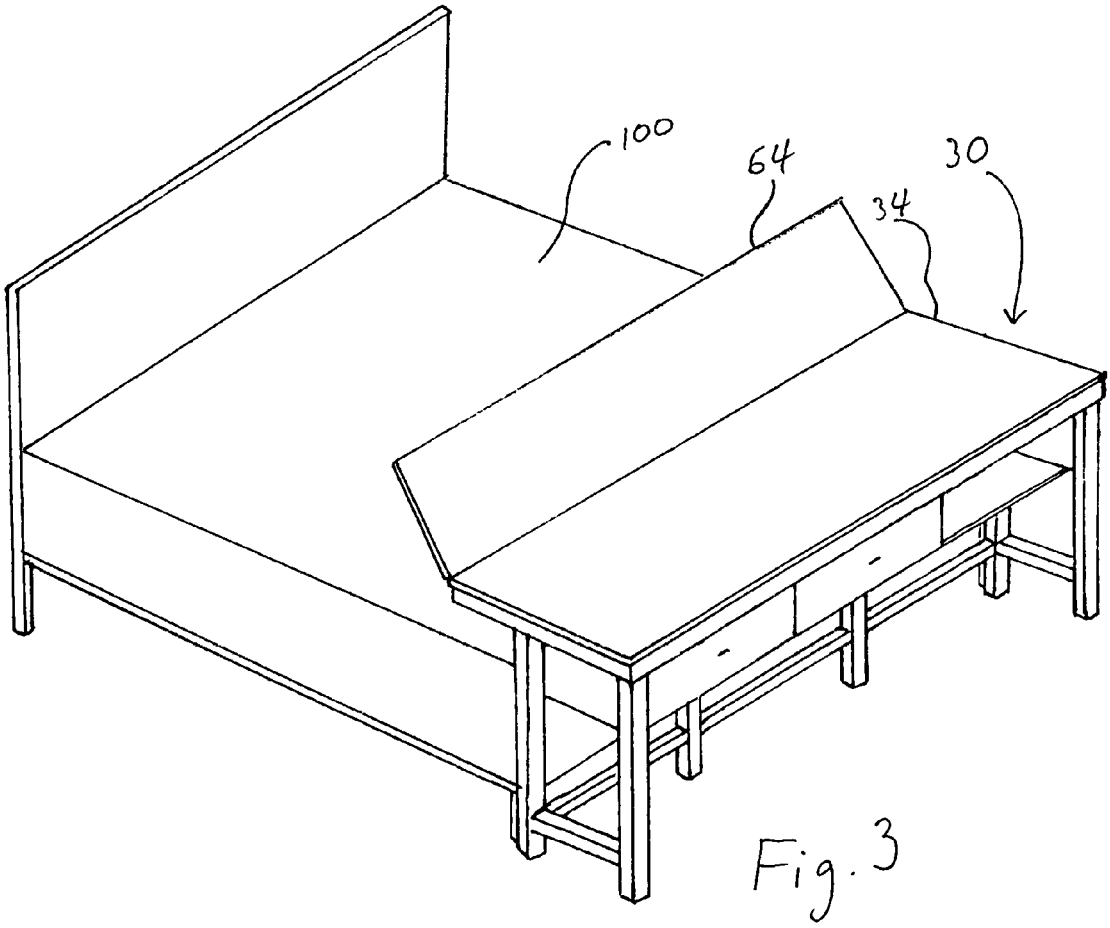
FIG. 3 is a perspective view of the embodiment of FIG. 1 with a second, pivotally attached desktop.
Figure 4:
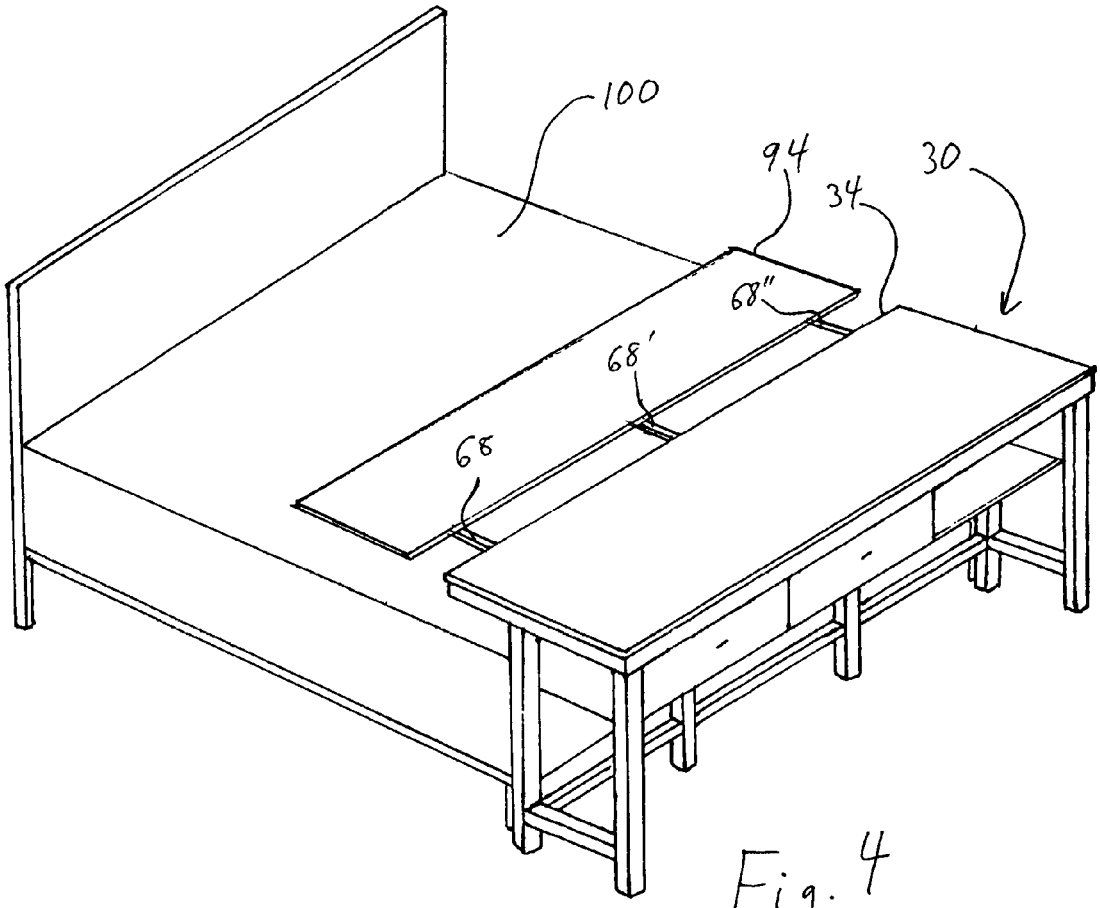
FIG. 4 is a perspective view of the embodiment of FIG. 1 with a second, slidable desktop.

Other means or attachments that can be incorporated into desktop 30 to increase useable surface area include the use of extendable portions of desktop 30. Examples of such extendable portions are shown in the embodiments depicted in FIGS. 3 and 4 and, for purposes of this description, are designated as second desktop 64. Although, given such designation, it is clear that second desktop 64 may be considered as a portion of desktop 34. In the embodiment shown in FIG. 3, second desktop 64 is disposed above desktop 34 and pivoting means (not shown), including but not limited to hinges, straps, etc., are utilized to rotate second desktop 64 into a useable position. FIG. 4 shows second desktop 94 disposed adjacent to desktop 34, and extendable arms 68, 68', 68' are used to slide second desktop 94 into desktop 34. The desktop may be of such a dimension that it does not extend over the bed, but rather that the second desktop extends over the bed and is extendable using extendable arms or a pivot so that the overall effect is of an initial surface area similar to that depicted in FIG. 1. The second desktop may alternatively be attached to, or disposed adjacent to, the main desktop such as at the edges and may slide under the main desktop.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. In combination with a bed adapted to be supported on a floor, said bed having a head supporting end and a foot supporting end, a footboard positioned adjacent the foot supporting end of said bed, said footboard comprising:

a plurality of supports separate from said bed, adjacent said bed, contacting said floor, and supporting said footboard adjacent said bed;

a generally planar first desktop disposed on said supports, said desktop extending over and above the foot supporting end of said bed and beyond in a direction opposite the foot supporting end of the bed; and said desktop being positioned sufficiently above the floor to define an open area beneath said desktop beyond the foot supporting end to accommodate a user's legs when the user sits adjacent said desktop and facing toward the bed, and to accommodate the resting of the users arms on said desktop, said desktop being at least as wide as the width of said bed.

2. The footboard of claim 1 further comprising at least one storage area disposed beneath said desktop.

3. The footboard of claim 2 wherein said at least one storage means comprises at least one drawer.

4. The footboard of claim 1 wherein said desktop is extendable so that a usable surface area of said desktop is increased.

5. The footboard of claim 1 wherein said desktop is extendable toward a head of the bed.

6. The footboard of claim 1 wherein said desktop is extendable away from a head of the bed.

7. The footboard of claim 1 further comprising at least one extendable arm to extend said desktop.

8. The footboard of claim 1 wherein a length of said legs is adjustable.

9. The footboard of claim 1 wherein said footboard is attached to the bed.

10. The footboard of claim 1 further comprising a side table.

11. The footboard of claim 10, said side table pivotally attached to said footboard.

12. The footboard of claim 1 further comprising a gate leg table.

13. The footboard of claim 1 wherein said desktop is pivotally attached to a second desktop, said second desktop disposed atop said desktop and foldable towards a head of the bed.

14. The footboard of claim 1 further comprising a second desktop disposed horizontally and adjacent said first desktop toward a head of the bed.

15. The footboard of claim 1 further comprising at least one shelf disposed on said desktop.

16. The footboard of claim 1 further comprising at least one shelf disposed under said desktop.

17. The footboard of claim 1 further comprising at least one electrical receptacle.

18. The footboard of claim 1 wherein said footboard is free standing.

19. A footboard for a bed that is adapted to be supported on a floor, said footboard comprising:

at least one support attached to the bed, contacting said floor, and supporting said footboard adjacent said bed;

a generally planar first desktop disposed on said supports, said desktop extending over and above the foot supporting end of said bed and beyond in a direction opposite the foot supporting end of the bed; and said desktop being positioned sufficiently above the floor to define an open area beneath said desktop beyond the foot supporting end to accommodate a user's legs when the user sits adjacent said desktop and facing toward the bed, and to accommodate the resting of the users arms on said desktop, said desktop being at least as wide as the width of said bed.

20. A method for providing a footboard for a bed that is adapted to be supported on a floor and having a foot supporting end, the method comprising:

providing a footboard comprising at least one support, the support contacting the floor and supporting the footboard adjacent the bed;

disposing a generally planar first desktop on the supports so that the desktop extends over and above the foot supporting end of the bed and beyond in a direction opposite the foot supporting end of time bed; and positioning the desktop sufficiently above the floor to define an open area beneath the desktop beyond the foot supporting end to accommodate a users legs, when the user sits adjacent the desktop and facing toward the bed, and to accommodate the resting of the user's arms on the desktop, the desktop being at least as wide as the width of the bed.

* * * * *